US006212707B1

(12) United States Patent
Thompson et al.

(10) Patent No.: US 6,212,707 B1
(45) Date of Patent: Apr. 10, 2001

(54) BOWED FRONT BATHROOM VANITY SYSTEM

(76) Inventors: Terry M. Thompson, 700 Crockett #405, Seattle, WA (US) 98119; Michael Zukun Ni, 5076 Inverness Rd., Vancouver BC (CA), V5W 3N6

( * ) Notice: Subject to any disclaimer, the term of this patent is extended or adjusted under 35 U.S.C. 154(b) by 0 days.

(21) Appl. No.: 09/545,499

(22) Filed: Apr. 7, 2000

(51) Int. Cl.[7] ..... A47K 1/00

(52) U.S. Cl. ..... 4/631; 4/619; 52/35; 312/140.3; D23/286

(58) Field of Search ..... 4/619, 625, 626, 4/630–636; 52/34, 35; 312/140.1, 140.2, 140.3, 140.4; D23/286, 284

(56) References Cited

U.S. PATENT DOCUMENTS

D. 32,044 * 12/1899 Hamm ..... D23/284 X
D. 157,050 * 1/1950 Jones ..... D23/286
D. 246,051 * 10/1977 Gruber ..... D23/286
965,164 * 7/1910 Dunbar ..... 4/619
5,735,001 * 4/1998 Bitsche ..... 4/631

FOREIGN PATENT DOCUMENTS

3930563 * 3/1991 (DE) ..... 4/630
5-68611 * 3/1993 (JP) ..... 312/140.3
6-277156 * 10/1994 (JP) ..... 4/630

* cited by examiner

*Primary Examiner*—Gregory L. Huson
*Assistant Examiner*—Kathleen J. Prunner
(74) *Attorney, Agent, or Firm*—David S. Thompson

(57) ABSTRACT

A bowed front bathroom vanity system is supported by a frame having a back and two side elements. A support substrate is supported by the three frame elements, and defines a hole for the sink and plumbing connections. A bowed front apron support bracket provides upper and lower rails connected by a plurality of support stanchions. The upper rail is carried by a recessed front edge defined on the support substrate. A bowed front apron and left and right apron wings, are typically made of stone or similar material, and are carried by the bowed front apron support bracket. A vanity surface is carried by the upper surface of the support substrate, and a back splash and opposed side splashes are carried by the vanity surface.

2 Claims, 4 Drawing Sheets

FIG. 4
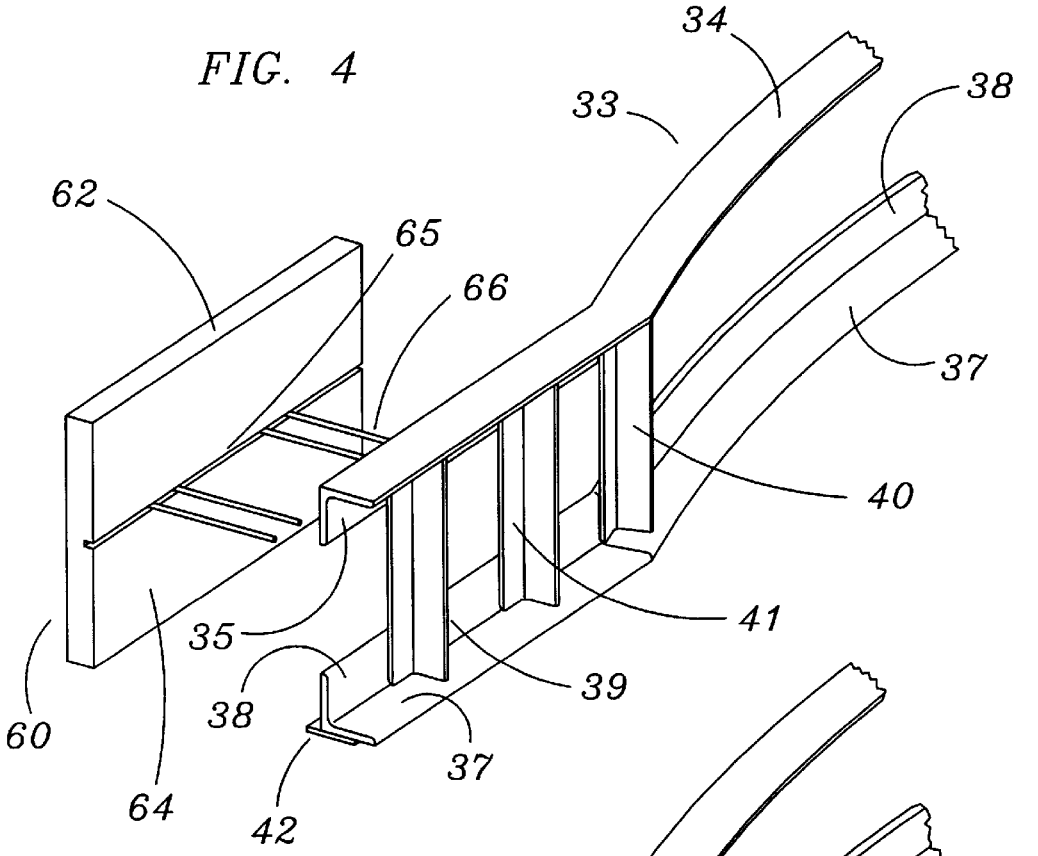
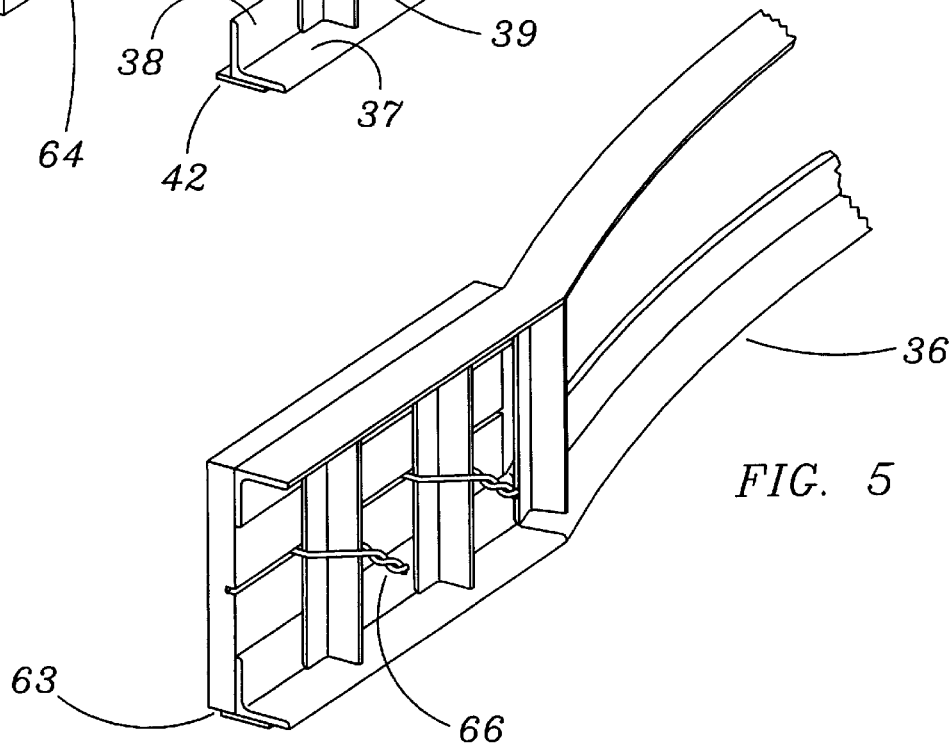
FIG. 5

FIG. 6
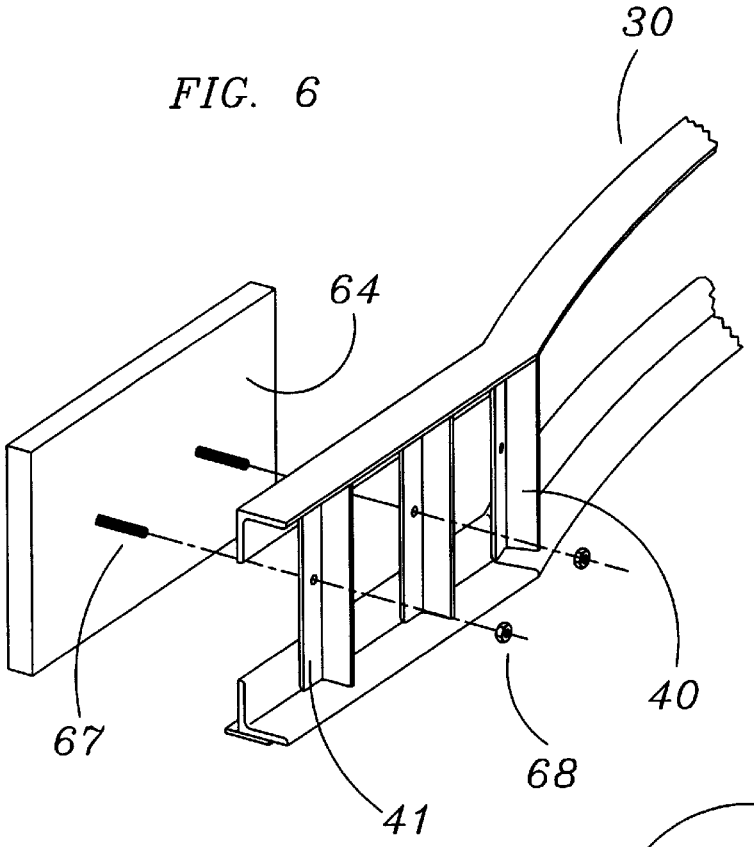
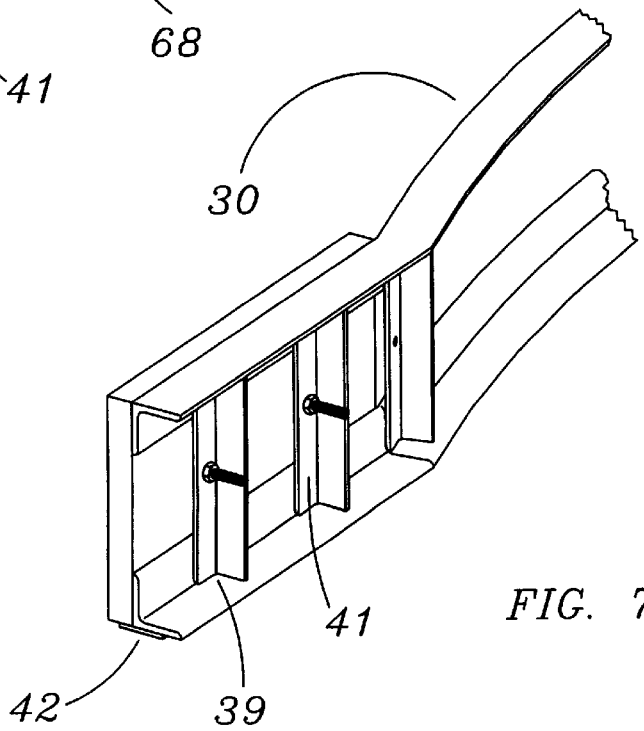
FIG. 7

BOWED FRONT BATHROOM VANITY SYSTEM

CROSS-REFERENCES

There are no applications related to this application filed in this or any foreign country.

BACKGROUND

It is well-known that the materials used to construct a bathroom vanity, i.e. the supporting and enclosing structure within which the sink and associated water and drain pipes are carried, can add considerably to the appearance of the final construction. In particular, where stone and similar synthetic materials are used, the appearance of the bathroom vanity can be substantially upgraded from the more typical use of lower quality materials.

Unfortunately, the use of stone has presented some substantial challenges to the construction industry. Most of the challenge relates to difficulty in aligning, fastening, and supporting material that is not, except for appearance, particularly well-suited for the application. In short, stone and similar stone materials are not materials that are well adapted for use in construction, but which are in high demand by consumers due to the end appearance of the construction.

Construction problems are magnified when stone is to be used to form a vertically oriented apron carried below the vanity surface, particularly where the apron is not flat or planar. Such stone may be desirable in conforming to the curved or bowed front of a bathroom vanity. However, the support of curved material presents additional challenges in aligning, supporting and fastening the material to the supporting vanity.

For the foregoing reasons, there is a need for a bowed front bathroom vanity system that allows for the alignment, support and fastening of difficult to use materials, such as stone, even in applications where the stone used to form an apron carried below the vanity surface is not planar, and assumes a bowed configuration.

SUMMARY

The present invention is directed to an apparatus that satisfies the above needs. A novel bowed front bathroom vanity system is disclosed that is adapted to aligning, supporting and fastening a curved or bowed piece of stone or similar difficult to use material, particularly where a bowed piece of stone is to be supported as an apron with the long edge oriented vertically on the front of the vanity.

The bowed front bathroom vanity system 10 of the present invention is typically mounted on a frame 100, which is in turn supported by opposed sides and an adjacent rear wall surface. A preferred frame includes a back frame element 110 connecting the rear end portions of the left and right side frame elements 120. A preferred version of the bowed front bathroom vanity system provides some or all of the following structures.

(A) A support substrate 20 is supported by the frame 100. A preferred plywood support substrate includes a bowed front and defines holes for the sink 200 and plumbing to the faucet fixtures.

(B) A bowed front apron support bracket 30 is carried by the recessed front edge of the plywood support substrate and by the front ends of the side frame elements. The bowed front apron support includes horizontally oriented upper and lower rails connected by vertically oriented support stanchions.

(C) A bowed front apron 50 is supported by the bowed front apron support bracket 30, and provides an aesthetic appearance.

(D) A pair of apron wings 60 are carried by the support bracket 30, on either side of the bowed front apron.

(E) A vanity surface 70 is carried on top of the support substrate, providing an aesthetic appearance.

(F) A back splash 80 and opposed side splashes 90 are supported by the upper surface of the vanity surface.

It is therefore a primary advantage of the present invention to provide a novel bowed front bathroom vanity system that provides a higher quality, more durable and more aesthetically appearing vanity than is possible with previous technology.

Another advantage of the present invention is to provide a novel bowed front bathroom vanity system that is more rapidly constructed than is possible with conventional construction technology.

A still further advantage of the present invention is to provide a novel bowed front bathroom vanity system that is less expensively constructed than is possible with previous technology.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

FIG. 4 is a perspective view of a fastening structure used to attach an apron wing to the bowed front apron support bracket, including wires positioned to wrap about the vertical stanchions.

FIG. 5 is a perspective view of the apron wing of FIG. 4 attached to the apron support bracket.

FIG. 6 is a perspective view of a fastening structure used to attach an apron wing to the bowed front apron support bracket, including bolts positioned for attachment to the vertical stanchions.

FIG. 7 is a perspective view of the apron wing of FIG. 6 attached to the apron support bracket.

DESCRIPTION

Figure 1:
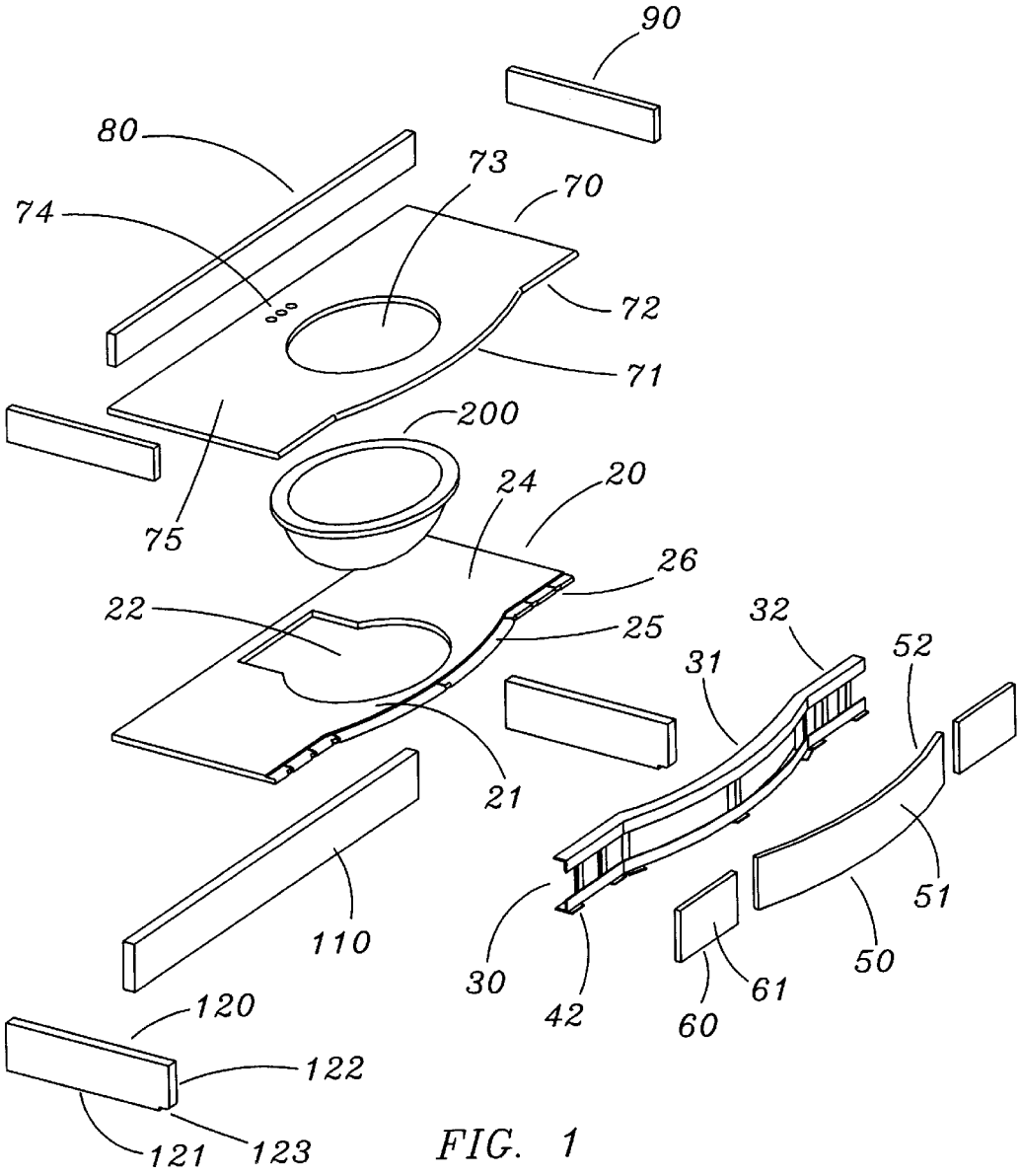
FIG. 1 is a perspective view of a version of the invention, exploded for purposes of illustration.

Referring in generally to FIGS. 1 through 7, bowed front bathroom vanity system 10 constructed in accordance with the principles of the invention is seen. A preferred version of the bowed front bathroom vanity system is supported by a frame 100 having a back and two side elements. A support substrate 20 is supported by the three frame elements, and defines a hole for the sink and plumbing connections. A bowed front apron support bracket 30 provides upper and lower rails connected by a plurality of support stanchions. The upper rail is carried by a recessed front edge defined on the plywood support substrate. A bowed front apron 50 and left and right apron wings 60, are typically made of stone or similar material, and are carried by the bowed front apron support bracket. A vanity surface 70 is carried by the upper surface of the support substrate 20, and a back splash 80 and opposed side splashes 90 are carried by the vanity surface.

As seen particularly in the exploded view of FIG. 1, the frame 100 supports the bowed front bathroom vanity system 10, and is typically constructed prior to installation of the vanity system. In most construction applications, the frame in turn is supported by the bathroom wall, and is made of finished 2" by 6" lumber having lengths appropriate to the bathroom into which the vanity system is to be installed. The exact dimensions of the frame, and materials used in its construction should be selected to fit the floor plan and construction of the application.

A preferred frame 100 comprises a back frame element 110 and two side frame elements 120. The length of the back frame element is typically the width of the support substrate 20, while the length of the side frame elements are approximately the depth of the support substrate.

Figure 2:
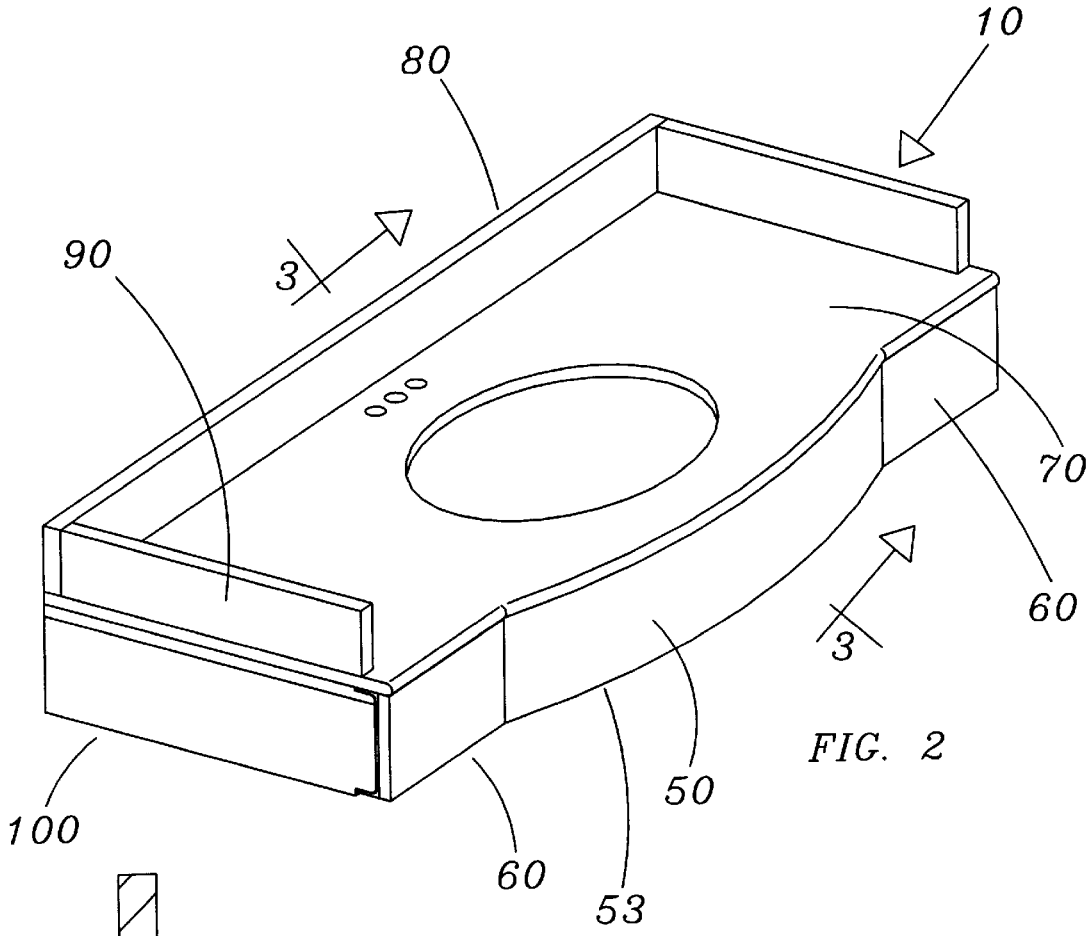
FIG. 2 is a perspective view of the version of the invention of FIG. 1 in an assembled form.

As seen in FIGS. 1 and 2, the lower edge 121 and front end 122 of the side frame elements 120 form a notch 123 which is sized to accept the horizontal iron 37 of the lower rail 36 of the bowed front apron support bracket 30.

A support substrate 20 is carried by the frame 100. In a preferred application, the support substrate is made of plywood, but in an alternate application any suitable building material could be substituted, including various pressed boards, synthetic materials, plastics and resins and other materials. A preferred plywood support substrate includes a bowed front 21 and defines at least one opening 22 for a sink 200 and plumbing to the faucet fixtures. As seen in the sectional view of FIG. 3, the sink is carried adjacent to the lower surface 23 of the support substrate 20, and is attached by conventional fasteners (not shown for clarity). As seen particularly in FIGS. 1 and 3, the upper surface 24 of the support substrate 20 supports the vanity surface 70.

As seen in FIG. 1, the support substrate defines a recessed front edge 25. The depth of the recession is calculated to be sufficiently deep to contain the horizontal iron 34 of the upper rail 33 flush with the upper surface 24, thereby forming a smooth upper surface against which the vanity surface 70 is carried.

Continuing to refer to FIG. 1, a plurality of L-shaped notches 26 are defined in the recessed front edge 25. Each L-shaped notch is incrementally larger than an associated also generally L-shaped support stanchion 39, allowing each L-shaped support stanchion to be inserted into one of the L-shaped notches.

An alternative support substrate 20 would define no opening 22 for a sink and no opening for plumbing to faucet fixtures. Such a support substrate would be adapted for use in a dressing table application, where a sink was not required.

Referring particularly to FIGS. 1 and 4–7, the bowed front apron support bracket 30 can be seen. A bowed front section 31 of the apron support bracket 30 supports the apron 50, while straight side wing sections 32 support apron wings 60 in a rigid and secure manner. As seen in the exploded view of FIG. 1, the apron support bracket 30 is carried by the recessed front edge of the plywood support substrate, and as seen in FIG. 2, by the front ends of the side frame elements 120.

The apron support 30 includes a horizontally oriented upper rail 33 and a similar horizontally oriented lower rail 36. As seen in FIGS. 4–7, a preferred version of the upper rail is made of angle iron, having a horizontal iron component 34 and a vertical iron component 35. Similarly, the lower rail includes a horizontal iron component 37 and a vertical iron component 38.

The upper and lower rails are connected by vertically oriented support stanchions 39. In a preferred embodiment, the support stanchions are made of angle iron, having first and second iron portions 40, 41. The iron portions are oriented in an L-shaped configuration, and are sized to fit within the L-shaped notches 26 defined in the support substrate 20.

As seen in FIGS. 1, 3, 4–7, a plurality of safety tabs 42 are carried by the lower surface of the horizontal iron 37 of the lower rail 36. The safety tabs are sized to support the bottom edge 53 of the bowed front apron 50 and the bottom edge 63 of the left and right apron wings 60. In a typical application, the safety tabs are welded to the lower rail, but could alternatively be attached by other fasteners, such as bolts or rivets.

Figure 3:
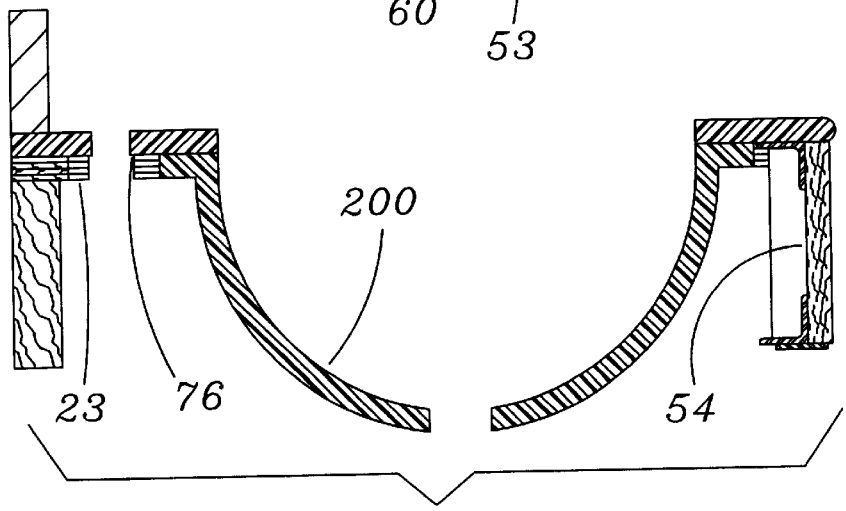
FIG. 3 is a thin sectional view, taken along the 2—2 lines of FIG. 2.

As seen in FIGS. 1–3, a bowed front apron 50 is supported by the bowed front apron support bracket 30. The bowed front apron enhances the aesthetics of the bowed front vanity system 10. In particular, the curvature of the gently curved or bowed front surface 51 tends to enhance the appearance of the entire vanity 10.

A top edge 52 of the bowed front apron 50 is carried adjacent to the lower surface 76 of the vanity surface 70. The bottom edge 53 is supported by a plurality of safety tabs 42.

As seen in FIGS. 1 and 4–7, left and right apron wings 60 are carried by the bowed front support bracket 30, on either side of the bowed front apron 50. The apron wings enhance the aesthetics of the bowed front vanity system 10. In particular, the symmetry achieved by bracketing the bowed front apron 50 between the planar left and right aesthetic front surfaces 61 tends to enhance the appearance of the entire vanity 10.

Top edges 62 of the apron wings 60 are carried adjacent to the lower surface 76 of the vanity surface 70. The bottom edges 63 are supported on a plurality of safety tabs 42.

In a preferred embodiment of the invention, the bowed front apron and left and right apron wings 60 are made of marble, stone or similar material, but alternatively, they could be made of any material suitable for use in the construction of a bathroom vanity.

The back surfaces 54, 64 of the bowed front apron 50 and the apron wings 60 are attached to the bowed front apron support bracket 30 by suitable fastening means. The fastening means, combined with the support given to the bottom edges 53, 63 of the bowed front apron and the apron wings by the safety tabs 42, result in a secure connection between the bowed front apron support bracket 30 and the bowed front apron 50 and apron wings 60.

Referring to FIGS. 4–7, two preferred versions of the fasteners used to attach the bowed front apron 50 and apron wings 60 to the bowed front apron support bracket 30 are seen. Alternative fastening means could be substituted, where appropriate. As seen in FIGS. 4 and 5, a horizontal groove 65 defined in the an apron wing or the bowed front apron is incrementally wider than the diameter of wires 66. The wires are held within the groove in part by friction. Additionally, glue, adhesive or cement-type compounds may be used within the groove to provide a secure connection between the wires 66 and the sidewalls of the groove 65.

As seen in FIG. 5, wires 66 may be wrapped about each vertical support stanchion 39, thereby securing the apron or apron wing to the support bracket 30.

Alternatively, as seen in FIGS. 6 and 7, a bolt 67 is carried by the back surface of the bowed front apron or the back surface of the apron wings. The head of the bolt is typically inserted into a hole defined in the back surface 54, 64 and cemented in place with adhesive. A bolt hole defined in the second iron 41 of each support stanchion 39 allows the bowed front apron or apron wing to be attached to the support bracket 30, and secure in place with a nut 68.

In a still further alternative, glue or adhesive only may be used to attach the bowed front apron or apron wing to be attached to the support bracket.

As seen in FIGS. 1–3, a vanity surface 70 is carried on top of the support substrate 20, providing an aesthetic appearance to the upper portion of the vanity system 10. A preferred vanity surface is typically made of the same or similar material used to make the bowed front apron and apron wings. As seen in FIG. 1, a bowed front edge 71 is curved in a manner similar to the curvature of the bowed front apron. Edges 72 are typically straight, and are of a length similar to the width of the apron wings 60. A hole 73 defined in the vanity surface is sized for the sink or basin 200, while holes 74 allow insertion of the plumbing necessary for the faucet and water supply.

In a dressing table application, no holes would be defined for a sink or associated plumbing fixtures.

Continuing to refer to FIGS. 1–3, a back splash 80 and opposed side splashes 90 are supported by the upper surface 75 of the vanity surface. The back splash and side splashes are generally made of the same material as the vanity surface, and may be constructed in an integral manner, so that the vanity surface, back splash and side splashes are formed as one piece.

The previously described versions of the present invention have many advantages, including a primary advantage of providing a novel bowed front bathroom vanity system that provides a higher quality, more durable and more aesthetically appearing vanity than is possible with previous technology.

Another advantage of the present invention is to provide a novel bowed front bathroom vanity system that is more rapidly constructed than is possible with conventional construction technology.

A still further advantage of the present invention is to provide a novel bowed front bathroom vanity system that is less expensively constructed than is possible with previous technology.

Although the present invention has been described in considerable detail and with reference to certain preferred versions, other versions are possible. For example, while in a preferred embodiment, the upper and lower rails and vertical stanchion are made of angle irons, an alternative material could be substituted. Also, while two preferred fastening structures, including wires 66 and bolts 67, have been disclosed, alternative fastening structures could be substituted. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A bowed front bathroom vanity system, supported by a frame, the bowed front bathroom vanity system comprising:

(A) a support substrate;

(B) a bowed front apron support bracket, carried by a recessed front edge of the support substrate, comprising:

(a) upper and lower horizontally oriented rails;

(b) at least three vertically oriented L-shaped support stanchions connecting the upper and lower horizontally oriented rails, the support stanchions having perpendicular first and second irons, wherein each of the at least three support stanchions pass through at least three L-shaped notches defined in the support substrate; and (c) at least three safety tabs, each safety tab carried by the lower rail;

(C) a bowed front apron, fastened to the bowed front apron support bracket and supported by at least one of the at least three safety tabs carried by the lower rail; and (E) a vanity surface, carried by the support substrate.

2. A bowed front bathroom vanity system, comprising:

(A) a frame, comprising first and second side frame elements connected by a back frame element;

(B) a plywood support substrate defining at least one hole sized for installation of a sink and plumbing to faucet fixtures, the plywood substrate supported by the frame;

(C) a bowed front apron support bracket, carried by a recessed front edge of the plywood support substrate and by front ends of the side frame elements, comprising:

(a) upper and lower horizontally oriented rails, the upper rail carried within the recessed front edge defined on the plywood support substrate;

(b) at least three vertically oriented L-shaped support stanchions connecting the upper and lower horizontally oriented rails, the support stanchions having perpendicular first and second irons, wherein each of the at least three support stanchions pass through at least three L-shaped notches defined in the plywood support substrate; and (c) at least six safety tabs, each safety tab carried by the lower rail;

(D) a bowed front apron, fastened to the bowed front apron support bracket and supported by at least two of the at least six safety tabs carried by the lower rail;

(E) first and second apron wings, fastened to the bowed front apron support bracket and supported by at least two of the at least six safety tabs carried by the lower rail;

(F) a vanity surface, carried by the plywood support substrate; and (G) a back splash and opposed first and second side splashes, supported by the upper surface of the vanity surface.

* * * * *